United States Patent [19]

Meyer, III

[11] 4,175,601

[45] Nov. 27, 1979

[54] HAND-HELD WEDGE TOOL FOR SPLITTING WOOD

[76] Inventor: Gustave C. Meyer, III, P.O. Box 187, Pottstown, Pa. 19460

[21] Appl. No.: 873,595

[22] Filed: Jan. 30, 1978

[51] Int. Cl.[2] ..... B26B 23/00

[52] U.S. Cl. ..... 145/1 R; 254/104

[58] Field of Search ..... 145/1 R; 254/104; 144/193 C, 193 D, 193 H, 193 A, 193 B

[56] References Cited

U.S. PATENT DOCUMENTS

| | | | |
|---|---|---|---|
| 111,333 | 1/1871 | Ficht | 144/193 R |
| 300,423 | 6/1884 | Wild | 254/104 |
| 508,221 | 11/1893 | Hill | 254/104 |
| 1,195,423 | 8/1916 | Waters | 254/104 |
| 3,185,442 | 5/1965 | Hemphill | 254/104 |

FOREIGN PATENT DOCUMENTS

| | | | |
|---|---|---|---|
| 597743 | 9/1925 | France | 145/2 R |

*Primary Examiner*—Othell M. Simpson
*Assistant Examiner*—J. T. Zatarga
*Attorney, Agent, or Firm*—Woodcock, Washburn, Kurtz & Mackiewicz

[57] ABSTRACT

An improved wedge of the multi-blade type, particularly adapted for hand-held use. Four tapered blades extend substantially 90° apart, and a short driving head arises from their midst. A separable point extends from the root of the four blades. The leading edges of the blades are raked at an angle which provides optimum penetration and splitting characteristics, and allows the wedge to be easily manipulated for use as a hand-held tool. The flanks of the blades are generally concave so that the transverse thickness of the blades increases slightly over the lower half of the blade length, but very substantially over the upper half.

9 Claims, 8 Drawing Figures

HAND-HELD WEDGE TOOL FOR SPLITTING WOOD

BACKGROUND OF THE INVENTION

The present invention relates to wood splitting apparatus, and more particularly to an improved multi-blade wood splitting wedge particularly well adapted for hand-held use.

As is well known, the use of wedge-shaped tools for splitting wood billets dates from antiquity as the need for splitting billets into smaller, more easily burned and handled pieces has existed for centuries. Accordingly, various types of tools have been devised to fill this need. The simplest, and by far most common, is a wedge-shaped piece of metal which is inserted into a crack or split in a wood billet, the split having been begun by an axe. As is well known by those familiar with the art of wood splitting, it is difficult to place a wedge directly upon the flat end of a wood billet, and drive the wedge into the wood surface. While this can be done, it is much simpler and easier to initiate a small split by means of an axe, and then place the wedge into the started split in order to force the split billet apart.

With the coming of the machine age, and while split logs were still commonly required for heating and the like, much attention was directed toward the machine-splitting of wood billets. In order to make use of the vastly increased power provided by machines, various sorts of multi-bladed splitting implements were devised. Among these are the machines disclosed in U.S. Pat. Nos. 508,221—Hill; 42,323—Wibirt; 383,690—Barrows; 111,333—Ficht; and 1,189,999—Peter. Another such machine is disclosed in French Pat. No. 586,618—Henri.

While the above-referenced patents all disclose multi-bladed wedges of various types it can be inferred that at least most of them were operable, in view of the great force developed by the associated machinery. A few approaches to the use of multi-bladed wedges as hand-held or hand-operated tools are shown in U.S. Pat. Nos. 1,364,737—Dudley and 3,515,372—Courville; and in Austrian Pat. No. 185,266—Schmidt.

In view of the renewed interest in conserving energy and more particularly in minimizing the use of fossil fuels, there is renewed interest in preparing wood for burning, and accordingly in the techniques of wood splitting. It will therefore be seen that it would be highly desirable to provide an improved wood splitting tool for cleaving a wood billet into several pieces, yet which avoids the deficiencies of the prior art and does not require the use of a machine to accomplish splitting of the billet.

It is therefore an object of the present invention to provide an improved hand-held wood splitting wedge of the multi-blade type.

Yet another object is to provide a hand-held wedge which may be driven into a wooden billet without the need for providing a starting split in the billet.

Another object of the present invention is to provide an improved multi-bladed wedge of the hand-held type which combines ease of wood penetration with optimum wood splitting effect.

SUMMARY OF THE INVENTION

Briefly stated, in accordance with one aspect of the invention the foregoing objects are achieved by providing a tool which can be easily grasped by a user, and surmounted by an enlarged striking head. At the lower end of the handle a plurality of tapered blades extend so as to divide a wood billet in generally equal segments. Each of the blades terminates at its lower edge in a sharpened leading edge, which is raked backward at an optimum angle of preferably 35°; and a point extends from the common, central root at which the blades meet.

In a preferred embodiment, the flanks of the tapered blades form generally concave surfaces so that the thickness of the lower portion of the blades increases only slightly but the thickness of the upper portion increases much more rapidly.

BRIEF DESCRIPTION OF THE DRAWING

While the specification concludes with claims particularly pointing out and distinctly claiming the subject matter which is regarded as the invention, it is believed that the invention will be better understood from the following description of a preferred embodiment taken in conjunction with the accompanying drawing in which:

DESCRIPTION OF A PREFERRED EMBODIMENT

Figure 1:
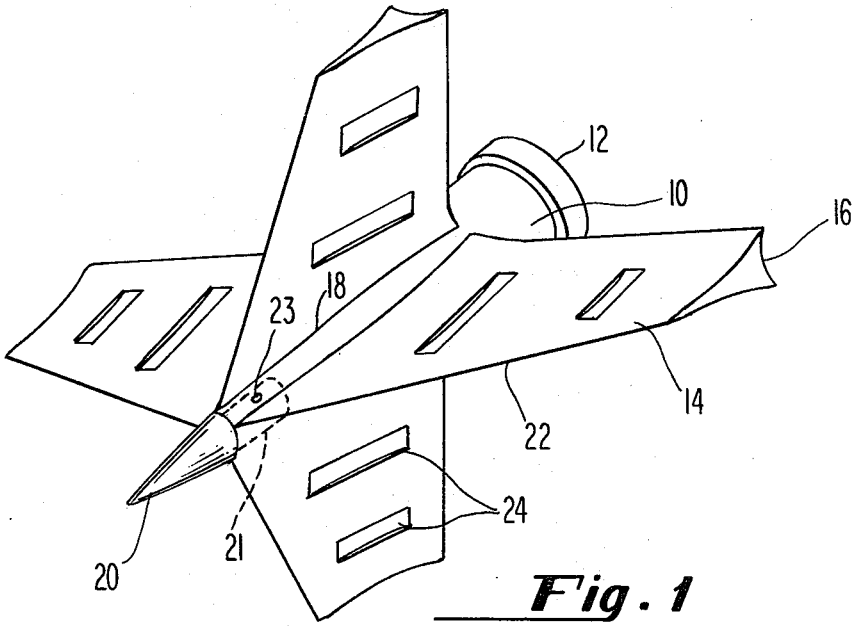
FIG. 1 is a perspective view of the inventive tool.

FIG. 1 illustrates the inventive tool, including a short stub 10 surmounted by an enlarged driving head 12. As will be explained hereinafter, while the precise length of the stub and driving head is not critical, it is important that they be as short as practically possible. Head 12 should be large enough to afford some protection to the surrounding parts of the apparatus, and must be thick enough to withstand repeated blows from an axe, sledge or the like. The specific size of the head will also depend to some extent upon the material from which the tool is made. In a preferred embodiment, the tool is cast as a single, monolithic piece from an appropriate alloy such as steel except for the tip 20, which may be a separate element.

The working portion of the tool comprises a plurality of blades 14, preferably four in number. The blades are arranged at substantially equal increments, in the present illustration 90° apart. The blades are identical, exhibiting a tapered cross-section and terminating at upper edges which lie generally in the same plane. The upper end surfaces 16 of the blades are preferably concave, thus extending the width of the blades yet minimizing the weight of the tool itself. The latter factor is an important one inasmuch as hand-held tools, unlike machine-driven tools, are quite limited in total weight and although it may be acceptable or even desirable to provide broad, thick surfaces for machine-operated tools this is a positive detriment where hand-held tools are concerned. Accordingly, the design of a successful hand-held tool of the type illustrated must combine size and strength necessary to accomplish the intended task, yet be sufficiently light to be continually manipulated by a user of average strength.

The blades converge to form a common, central root area 18. The present inventor has found that it is highly desirable to provide a root whose cross-sectional measurement (i.e. the distance from the vertex of one pair of blades to the vertex of the other pair) is less than $\frac{3}{4}$ inch. Experimentation has shown that this dimensional limitation is substantially constant, even for wood billets of greatly disparate sizes. In like manner, the diameter of the locating point 20 should be less than $\frac{3}{4}''$ and in a presently preferred embodiment is $\frac{3}{8}''$. In a preferred embodiment the locating point is formed separately from the body of the wedge, and provided with a shank 21 of reduced diameter. The shank fits closely into a hole drilled at the intersection of the blades, directly into root 18. Shank 21 may be press-fitted into the bore, but in a preferred embodiment is locked in place with a split-pin type of expansion plug 23.

Extending radially outwardly from the central, locating point are the leading edges 22 of the various blades which are swept back, or raked, at an angle to be discussed more fully hereinafter. Further, the present inventor has found that by providing a series of longitudinally-directed reliefs 24 the mass of the tool can be reduced still further.

Still another, and also critical, aspect of the invention is the rather short length of the stub 10 upon which the driving head is formed. While it might normally be expected that for a hand-held tool the stub which couples driving head 12 to the body of the tool should be fairly long, so as to afford a facile handgrip for a user, the inventor has established that precisely the opposite is true. Surprisingly, and contrary to normal expectations, it has been found that the splitting operation of the wedge is substantially increased with the reduction in the mass thereof so that a lighter tool of the type depicted actually splits wood billets more effectively than a heavier one. Although in the past wood splitting apparatus has typically been purposely made as heavy, or massy, as feasible, experiments conducted by the inventor have unexpectedly shown that the wood splitting ability of a wedge with a head assembly of minimal size is substantially better than is the case when the stub 10 is long enough to serve as a handle. At the same time, it has been determined that the driving head must be elevated at some distance above the rearward edges of the flanks of the splitting wedge so that the sledge or other driving implement contacts a centrally-located area, and does not damage or distort the lateral portions of the tool. This elevation also serves to protect the hand of a user when one blade is grasped and the upstanding head is struck with an axe, sledge or the like. In one successfully-tested embodiment, for example, the elevation distance d of the driving head was approximately 1 inch. This accommodates a driving head which is sufficiently massy to absorb repeated blows from a driving implement, yet minimizes the mass of the total implement.

Figure 2:
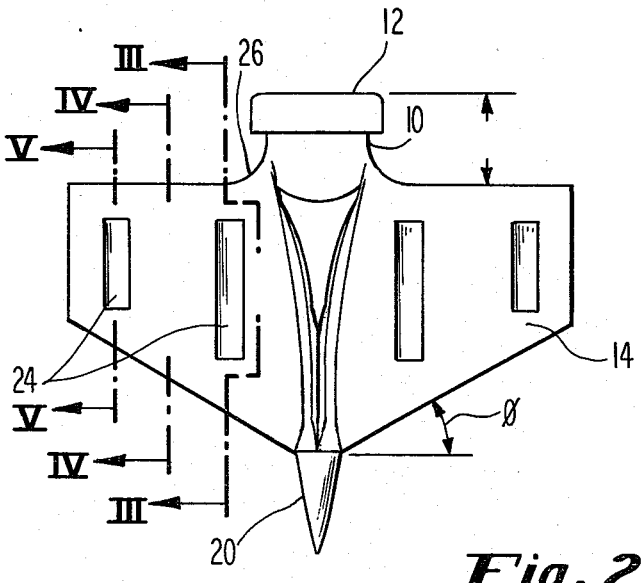
FIG. 2 is a side elevation of the tool, illustrating features of its construction.

Turning now to FIG. 2 it will be seen that the concave trailing surfaces of blades 14 blend into handle 10 by means of fillets 26, further strengthening the tool without adding undue weight. The reliefs 24 are preferably of approximately $\frac{1}{8}$ inch in depth, and extend generally parallel to the axis of the tool so that the edges thereof do not in any way impede the progress of the tool through a wooden billet. While two such reliefs are shown in the tapered side of each blade those skilled in the art, after having recourse to the present disclosure, will appreciate that the depth, location and number of the reliefs may be varied to suit a particular application. In addition other configurations of reliefs, such as triangular or longitudinally concave reliefs, may be selected depending upon the application.

As set forth above, a locating point 20 extends from the root or juncture of the blades. Although this enlarges the cross-sectional area of the tool which is presented to the wood surface, it has been found that the increase in area is more than offset by the utility of the point. Point 20 not only serves to facilitate entry of the wedge blades into a flat, unsplit surface of a wooden billet, but further assists in locating the tool preparatory to its being driven into a billet. In this manner the point may be placed upon the exact spot at which the intersections of the splits should occur, such as the geometric center of the wooden billet. The weight of the tool is itself ordinarily sufficient to keep the point 20 from slipping about upon the billet end surface, and thus a user need only apply enough force to keep the tool generally upright upon the wooden surface, or in other words, to balance it on its point while an initial blow is struck upon the upper surface of head 12. After point 20 is driven into the end surface of the wooden billet the user may release his grasp and use both hands to swing the axe or sledge for driving the tool into the billet, to ultimately split the billet.

The present inventor has discovered that, contrary to the established practice for hand-held splitting tools, it is necessary to provide the leading edges with a rake angle, both to facilitate initial entry of the tool into an unsplit billet and to enchance the splitting action of the tool as it proceeds through the grain of the wood. Hence, the raked-back leading edges of the various blades preferably extend to the periphery of locating point 20 without providing any flat, or unraked, leading surfaces near the center of the tool.

A critical aspect of the invention is the angle $\phi$ at which the sharpened, leading edges of the tool are raked. In a successfully-tested embodiment, in which the span of the blades was approximately 7 inches, a preferable angle $\phi$ was found to be substantially 34°. In the same tool, the diameter of locating point 20 was effectively $\frac{3}{8}$ inch. As set forth above, this dimension should not exceed $\frac{3}{4}''$ for the tool to be effective, regardless of the actual size of the tool. The preferred rake angle is also relatively independent of the absolute size of the tool, and it is believed that the optimum angle of approximately 35° should be maintained for best operation of the tool. It is understood, however, that other angles may be chosen without departing from the thesis of the invention; and angles in the range of from approximately 15° to 50° may be used.

Figure 3:
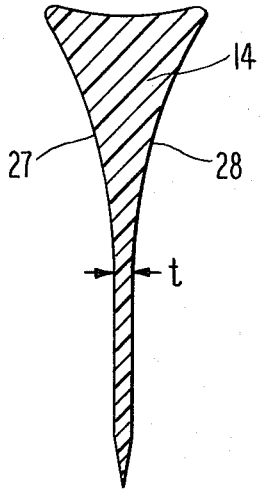
FIGS. 3–5 represent sections taken at III—III, Iv—IV and V—V of FIG. 2 respectively.
Figure 4:
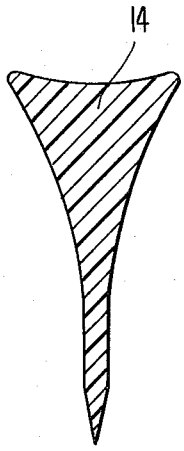
Figure 5:
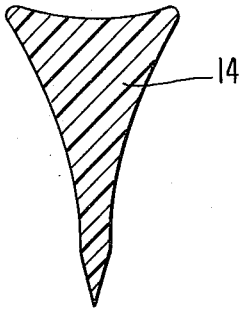

FIGS. 3, 4 and 5 illustrate another unique, and also critical, aspect of the invention. FIGS. 3, 4 and 5 represent cross-sectional views taken at III—III, IV—IV and V—V of FIG. 2, respectively. As seen in FIG. 3 the flanks 27, 28 of blade 14 are tapered only slightly for approximately the lower one-half thereof. The thickness t of approximately the lower one-half of the blades is preferably from 3/16" to $\frac{1}{4}''$ regardless of the manner of sharpening of the lowermost or leading edge of the blade.

The uppermost one-half of the blade, as shown in FIG. 3, increases at a much more rapid rate and in a preferred embodiment is concave, substantially as shown. Although it is not believed that any one precise configuration is required, it has been found substantially and unexpectedly advantageous to provide a configuration of the type shown wherein the flanks of approximately the lower one-half of the blades (at their deepest or innermost section) are tapered very little or are parallel; and the upper one-half of the flanks are tapered very steeply. In a presently preferred embodiment the maximum taper of the lower flanks (included angle) is no more than substantially 6°. When the tapering is continuous, so as to approximate a continuous curve, such a curve might generally be described as approximating an exponential function inasmuch as the curvature of each flank begins (at its lower end) very gradually, then increases at an ever-accelerating rate as it progresses toward the upper or trailing edge of the blades. Such a curvature is shown in FIGS. 3–5.

While the exact phenomena involved in using the illustrated tool are not completely understood, it is believed that the lowermost portion of the blade serves to penetrate the wooden billet, without effecting any substantial separation of the pieces. After substantial penetration is achieved, for example the lower one-half of the blades, a separating rather than penetrating action is required. It is at this point that the thickness of the blades begins to increase substantially, causing the partially-separated pieces of the billet to be split apart. It has been discovered that if the thickness of the blades increases rapidly from the lowermost edges thereof, it is extremely difficult to manually force the tool to penetrate the wood billet such as by using an axe or sledge. On the other hand, if the blades are relatively thin and not tapered to a substantial degree, the tool will fully penetrate the billet but remain wedged therein, without splitting the billet into segments.

Rather than maintaining the same proportionality of substantially non-tapered to steeply-tapered portions of the blade depth, the inventor progressively shortens the lower, substantially untapered portion of the blade to achieve the taper angle $\phi$ shown in FIG. 2. Accordingly, as shown in FIGS. 4 and 5 the uppermost, steeply tapered portions of the flanks of blade 14 remain substantially unchanged while the length of the substantially untapered, narrow portion thereof becomes shorter. For present purposes the configuration of each blade may be considered to be constant, that is, any given transverse dimension of the blade is continuous when projected radially outwardly from the center of the tool. This configuration will be described as comprising substantially symmetrical flanks which extend parallel to one another.

Figure 6:
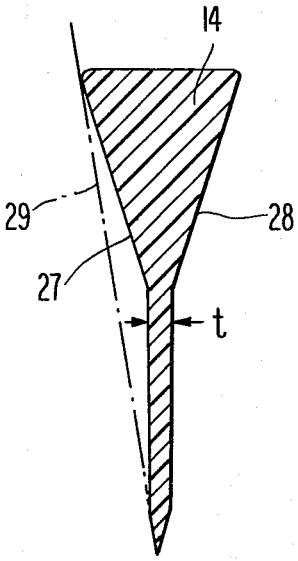
FIGS. 6–8 represent sections of another embodiment and which correspond to FIGS. 3, 4 and 5 respectively.
Figure 7:
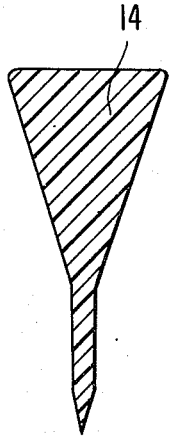
Figure 8:
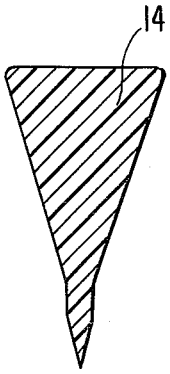

FIGS. 6, 7 and 8 illustrate an alternative embodiment of the present invention, and correspond to sections taken at the same positions as FIGS. 3, 4 and 5 respectively. In the context of the present invention the cross-sectional configuration of the flanks in FIGS. 6 through 8 is still considered to be concave inasmuch as the blade flank retreats from a straight line 29 drawn between the upper and lower edge of each flank. As was the case in FIGS. 3 through 5 the lowermost one-half of the blade, taken at its largest dimension, has a thickness t of approximately ¼", and moreover has a very slight taper, substantially as shown. The upper one-half of the blade exhibits a much steeper taper, so that the effective configuration of the flank roughly approximates a curve of sharply increasing slope, such as an exponential function. As was described with respect to the embodiment of FIGS. 3 through 5, the slight taper of the lower portion of each blade serves to facilitate entry of the tool into a wooden billet, and further allows the tool to be driven into an initial depth which is adequate to keep the tool from bounding out of a partially-split billet due to the resiliency of the wood. At the same time the substantially increasing slope of the upper half of the blades creates a rapid splitting effect. Surprisingly, this effect is substantially uniform in wood billets of disparate sizes and complete splitting occurs before the tool is driven completely into the billet.

From the foregoing, it will be seen that there has been described herein an improved hand-held tool for splitting a wooden billet into a number of pieces, and which penetrates the billet impelled only by blows from a hand-held implement such as an axe or sledge. Further, it will be seen that the instant device is of minimal weight, thus enhancing its utility and, moreover, facilitating the location of the precise point of splitting which is desired.

As will be evident from the foregoing description, certain aspects of the invention are not limited to the particular details of the examples illustrated, and it is therefore contemplated that other modifications or applications will occur to those skilled in the art. It is accordingly intended that the appended claims shall cover all such modifications and applications as do not depart from the true spirit and scope of the invention.

What is claimed as new and desired to be secured by Letters Patent of the United States is:

1. An improved hand-held tool for splitting wood billets, comprising:
   - a plurality of blades extending outwardly from a central root area, said blades being spaced one from the other by substantially equal increments;
   - each of said blades having a sharp leading edge and a trailing edge, said leading edges having substantially identical rake angles in the range of from 15° to 50°;
   - an enlarged head upstanding from the juncture of said trailing edges of said blades for receiving blows from hand-held striking implements;
   - the flanks of each of said blades having a non-uniform taper whereby substantially the leading half of each blade, seen at its inward extremity, having a first small taper of from zero to 6°, and substantially the trailing half of each blade, seen at its inward extremity, having a second taper substantially greater than the taper of said leading half;
   - said flanks being substantially symmetrical about the center of each blade, and each said blade having a rectangular cross-section in a horizontal plane; and
   - a locating point extending from the leading edge of said central root area.

2. A tool according to claim 1, wherein said locating point is formed separately from the body of said tool.

3. A tool according to claim 1, wherein said rake angle is approximately 35°.

4. A tool according to claim 1, wherein said flanks of said blades are generally concave.

5. A tool according to claim 4, wherein said first and second tapers are defined by substantially flat surfaces.

6. A tool according to claim 4, wherein said first and second tapers are defined by a continuous curved surface whose configuration approximates an exponential function.

7. An improved hand-held wedge tool for splitting wood billets, comprising:
   - four substantially identical blades extending approximately 90° apart from a central root area, each of said blades having a sharp leading edge and generally coplanar trailing edges, and said leading edges having substantially identical rake angles in the range of from approximately 15° to 50°;

a driving head upstanding some distance d from the trailing edges of said blades, said distance d being less than approximately 1"; and a generally conical locating point extending from the convergence of said leading edges, the maximum thickness of said root area at its lowermost extremity not exceeding ¾";

wherein the effective configuration of each of the flanks of said blades roughly approximates a curve of decreasing exponential slope from the leading edge to the trailing edge;

and wherein said flanks are substantially symmetrical and extend parallel to one another in a plane perpendicular to the axis of the root area.

8. A tool according to claim 7, wherein said head and blades are integrally formed of a single casting, and said point is a separate member attached to said casting.

9. A tool according to claim 7, wherein said rake angle is substantially 35°.

* * * * *